United States Patent [19]

Richter

[11] Patent Number: 4,666,146

[45] Date of Patent: May 19, 1987

[54] SEPARATING APPARATUS FOR PRINTED PRODUCTS, PARTICULARLY FOR DISTRIBUTING FOLDED PRINTED PRODUCTS INTO DISCRETE PATHS

[75] Inventor: Johannes Richter, Augsburg, Fed. Rep. of Germany

[73] Assignee: M.A.N. Roland Druckmaschinen Aktiengesellschaft, Augsburg, Fed. Rep. of Germany

[21] Appl. No.: 883,077

[22] Filed: Jul. 8, 1986

[30] Foreign Application Priority Data

Jul. 20, 1985 [DE] Fed. Rep. of Germany ..... 3526060

[51] Int. Cl.[4] ..... B65H 39/10

[52] U.S. Cl. ..... 271/303; 271/312; 271/178

[58] Field of Search ..... 271/297, 303, 304, 306, 271/312, 177–179

[56] References Cited

U.S. PATENT DOCUMENTS 3,472,506 10/1969 Rabinow ..... 271/304
4,538,800 9/1985 Richter ..... 271/304

FOREIGN PATENT DOCUMENTS 0054963 6/1982 European Pat. Off. .
1786264 12/1971 Fed. Rep. of Germany .

*Primary Examiner*—Richard A. Schacher
*Attorney, Agent, or Firm*—Frishauf, Holtz, Goodman & Woodward

[57] ABSTRACT

A pair of supply belts (3, 4) pass vertically towards an open deflection drum (5) which has two peripheral deflection segments (6, 7), one (4) of the supply belts then is joined by another belt (9), the junction forming an inlet funnel or zone (14) which deflects a printed subject (1) clamped between the supply belts to a first belt system now formed by one of the supply belts and one (9) of the delivery belts. The other (3) of the supply belts passes vertically through the open drum and, in combination with a second delivery belt (10), receives those printed subjects (2) which are not deflected by the segments (6, 7), that is, which are in the path through the drum when the segments (6, 7) are outside the path through the drum. To prevent interference between a deflection roller (11) and the first delivery belt looped thereabout, and a printed subject being fed through the drum, a shield element (13) shields the counter-rotating deflection roller and run of the first delivery belt (9) thereabout from vertically fed printed subjects (2) passing through the open drum.

12 Claims, 1 Drawing Figure

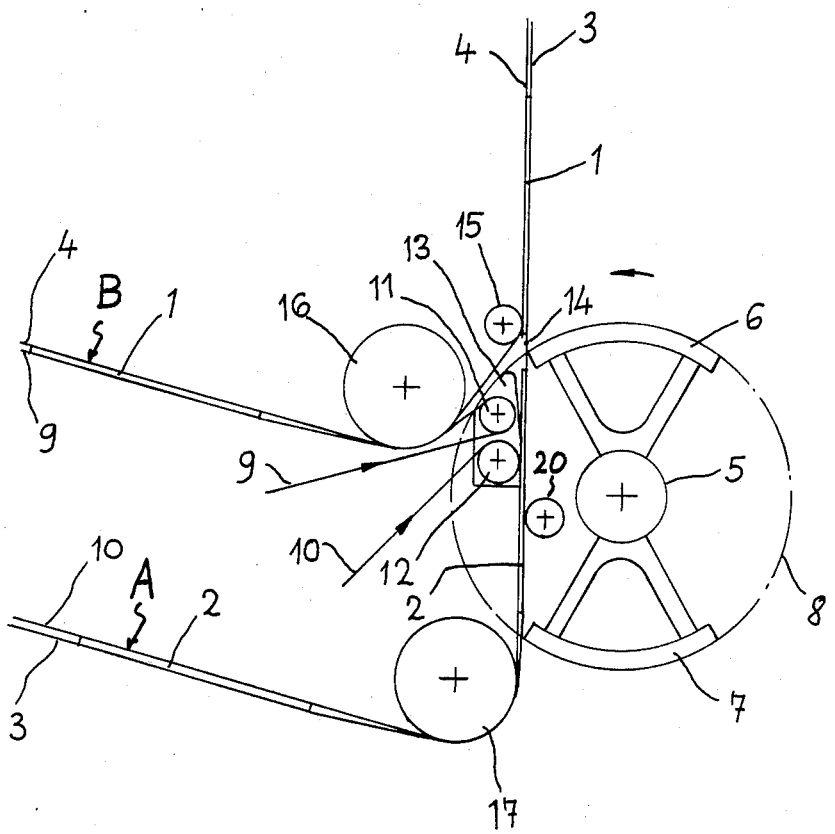
4
3
1
15
13
11
14
4
B
1
16
6
9
9
20
5
10
12
10
A
2
2
8
3
7
17

SEPARATING APPARATUS FOR PRINTED PRODUCTS, PARTICULARLY FOR DISTRIBUTING FOLDED PRINTED PRODUCTS INTO DISCRETE PATHS

The present invention relates to handling of paper products, and more particularly folded paper products received, for example, for a printing machine, in which the folded paper products are supplied in a single supply stream and the apparatus separates the products for delivery in at least two discrete delivery paths.

BACKGROUND

It has previously been proposed to separate printed products, typically folded printed products supplied from a printing machine into discrete paths. For example, European Patent Application No. 0054 963 describes an arrangement in which a vertical supply transport belt arrangement supplies printed products in a vertical path, in which the printed products are spaced from each other along supply belts running downwardly. Two oppositely rotating deflection elements are provided to guide the printed products towards respective delivery belt lines. A fixed tongue is located between the deflection elements, which include deflection segments. The tongue has an edge which, to prevent damage to the respective printed products, is covered alternately by a deflection segment of a deflection element, so that the arriving printed products are deflected either towards the left or towards the right of the tongue for further transport to the respectively associated belt transport device. The use of two deflection segments is complex, space consuming, and hence expensive.

It has also been proposed to separate printed products and guide them towards two separate belt transport devices without using a fixed tongue. This arrangement, also, requires two rotating segment-like deflecting bodies—see the referenced German Pat. No. 1 786 264.

THE INVENTION

It is an object to simplify a separating apparatus for delivery of paper products, typically printed folded paper products received from a printing machine, which does not require a separating tongue, which is inexpensive and reliable.

Briefly, a supply belt system which is formed by two parallel belts between which the printed products are located is guided in a vertical, downwardly running direction. A rotating deflection drum has at least one, and preferably two diametrically oppositely located deflection segments thereon which, upon rotation, define a theoretical rotating cylinder. Two delivery belts are provided, each one cooperating with one of the supply belts. The delivery belts are so guided by belt deflection rollers that one delivery belt and a deflected one of the supply belts grasp printed products which are engaged by the deflection segment. Upon continued rotation of the deflection segment, however, and beyond its trailing edge, a space will be left within the theoretical rotation cylinder to permit a subsequent printed product to be fed vertically downwardly within the theoretical cylinder, to be then grasped between the other one of the supply belts and the other one of the delivery belt. Suitable deflection rollers guide the delivery belts and the supply belts in their respective paths. Since one of the deflection rollers will have a surface rotating in a direction counter the direction of delivery of the sheets, a shield is provided to prevent spurious engagement of the printed product with the counter-rotating roller.

DRAWING

The single FIGURE is a schematic side view of the separating arrangement, from which all elements not necessary for an understanding of the present invention, and which may be of routine structural form, have been omitted.

Printed products, typically folded cut products which may be of multiple sheets are supplied between transport belts 3, 4 in approximately vertical direction. Two such products 1, 2 are shown in the drawing. As can be seen, the structure of the present invention requires only a single rotating element in form of an drum 5 which has at least one, and preferably two diametrically oppositely located deflection segments 6, 7 on the circumference thereof. No separate fixed separating tongue or switching element is required.

The deflection drum, essentially, is formed by the rotating element 5 with the deflection segments 6, 7 thereon. The deflection segments 6 and 7 on the drum 5 rotate with a predetermined speed which is matched to the speed of the arriving printed products 1, 2 which, usually, will be folded. Upon rotation of the drum 5, the deflection segments 6, 7 will define a theoretical rotation cylinder shown in the drawing by the chain-dotted circle 8. Of course, a plurality of transport belts 3, 4, as well as a plurality of deflection drums, can be located next to each other, in planes parallel to the plane of the drawing, corresponding to the width of the products 1, 2.

In accordance with a feature of the invention, first and second delivery belts 9, 10 are provided, looped over respective deflection rollers 11, 12 which are located within the theoretical rotation cylinder 8. The deflection rollers 11, 12 are located vertically above each other. Delivery belt 9 is guided from below about the deflection roller 11 and, in combination with the supply belt 4, will form a delivery belt system to deliver printed products 1 in a path B. The belt 10 is guided above the deflection roller 12 and then next to the supply belt 3 to form, together with the supply belt 3, a delivery belt system to deliver printed products 2 in a path A. As can be seen from the drawing, the run of the belt 9 which is looped about the deflection roller 11 from below will run over the deflection roller 11 in a direction which is counter the delivery direction of the products 1, 2 which are delivered vertically downwardly between the supply belts 3, 4. Consequently, the run of the belt 9 within the theoretical rotation cylinder 8 will be counter the direction of the continued movement of the printed goods 2 which are to be guided in a straight line through the portion of the theoretical rotation cylinder which is not covered by one of the segments 6, 7—see the drawing. To prevent spurious engagement of printed products with the deflection roller 11, or the run 9 about the deflection roller 11, a cover shield 13 is provided, which extends at least slightly beyond the periphery of the roller 11 and, preferably, has a rounded tip portion to form, together with the belt 3, a receiving funnel for printed goods 2 which are to travel vertically through the theoretical rotation cylinder 8. The shield 13 prevents contact of the printed goods 2 with the deflection roller 11 or the respective belt 9. Preferably, the shield 13 is elongated and positioned laterally on a suitable support structure provided for the deflection rollers 11, 12. Such a support structure has been omitted since it can be constructed in any suitable manner.

Operation: The printed products 1, 2, supplied between the belts 3, 4, are separated by the rotating segments 6, 7 for delivery in the respective paths A, B. Upon presence of one of the segments 6, 7 in the region or zone 14, that is, just above the top portion of the deflection segment 13, an odd one of the printed products 1 is deflected by the respective deflection elements 6, 7 and fed into the path of the belt 4 and the belt 9, to be clamped between belts 4 and 9, for further delivery in the path B. Preferably, the inlet portion between the belts 4, 9 is funnel-shaped, and the width or shape of the funnel can be varied by suitable placement of further deflection rollers 15, 16 engaging belt 4. Preferably, the position of at least the deflection roller 16 is adjustable, for example by journaling the shaft of the deflection roller 16 in an eccentric or slidable bearing. Upon continued rotation of the drum 5, and after the printed subject 1 has been delivered, a next even-numbered printed subject 2 will arrive in the zone 14. At that point, the trailing end of the respective segment has passed the zone 14 and the next, or even-numbered printed subject is fed vertically downwardly along the belt 3 to be received and engaged between belt 10 and belt 3, and to be subsequently guided into the path A by a further deflection roller 17. The belt 10 is deflected by the deflection roller 12 located within the theoretical rotation cylinder 8, so that printed subjects 2 can be clamped between the belts 3 and 10 for further delivery in accordance with the selected path A, for example as determined by the roller 17 and further deflection rollers, not shown. Preferably, the roller 17 is so positioned that its outer circumference is tangential with respect to the initial delivery direction of the belts 3, 4.

As can be seen, the odd-numbered printed subjects 1 are deflected by the respective elements 6, 7, and subsequent or even-numbered products pass straight through the theoretical rotation cylinder 8. The odd-numbered products are deflected in advance of the lower run of belt 9 about the deflection roller 11, that is, before any engagement with the counter-rotating roller 11 might occur.

In a preferred form, two deflection segments 6, 7 are provided, located diametrically oppositely each other on the drum 5. When two such segments are used, the maximum length of the printed subjects 1, 2 must not be larger than their path through the theoretical rotation cylinder 8, that is, must not be larger than a chord through the circle defined by the theoretical rotation cylinder, and shown in chain-dotted lines in the drawing, The supply belts 3, 4 thus form also part of the delivery belt system; only one additional or auxiliary delivery belt 9, 10 is required for each path, the other delivery belt being formed by an extended portion of the respective supply belts 3, 4 are deflected by the rollers 17, 16, respectively. Additional guide rollers may be used, of which one further guide roller 20 is shown as an example.

The apparatus is particularly suited to separate printed subject matter which has been folded in a compact and simple folding apparatus described in the referenced copending application assigned to the assignee of the present application, U.S. Ser. No. 883,076, filed July 8, 1986, RICHTER (claiming priority of German Application No. P 35 26 059.9 of July 20, 1985; attorney docket FF 86352-shf; PB 3344/1743).

I claim:

1. Separating apparatus for delivery of printed products arriving in a single stream into at least two paths (A, B) having a belt transport arrangement including a first supply belt (3) and a second supply belt (4), said first and second supply belts running parallel to each other with the printed products (1, 2) being longitudinally staggered and held between the parallel belts, comprising, in accordance with the invention, a rotating deflection drum (5) which has at least one deflection segment (6, 7) located peripherally on the drum and defining, upon rotation of the drum, a theoretical rotation cylinder (8);

a first (12) and a second (11) belt deflection roller located within said theoretical rotation cylinder;

a first (10) and a second (9) delivery belt, each (11, 12) of said deflection rollers deflecting an associated one (9, 10) of said delivery belts, and guiding said delivery belts to form, together with a respective one of said first and second supply belts (3, 4), two delivery belt systems, each comprising a pair (3-10; 9-4) of belts to deliver the products, selectively, in said respective paths;

one (11) of said deflection rollers being located with its circumference close to the theoretical rotation cylinder (8) for guiding the associated delivery belt (9) to receive those printed products (1) which arrive at the drum while the deflection segment (6, 7) is in a position to engage and deflect the printed product towards the circumference of the theoretical rotation cylinder (8), another (10) of said deflection rollers being located further inwardly of said theoretical rotation cylinder (8) than said one (11) of said deflection rollers for guiding the associated delivery belt (10) to receive those printed products (2) which arrive at the theoretical rotation cylinder while the deflection segment (6, 7) is in a position remote from those printed products and thereby permit passage of those printed products through the theoretical rotation cylinder (8);

and a covering shield (13) covering the portion of said one (11) of the deflection rollers which rotates in a direction counter the direction of movement of those products (2) which pass through said theoretical rotation cylinder (8).

2. The apparatus of claim 1, wherein the supply belts (3,4) guide said printed products towards said deflection drum (5) in an essentially vertical path, and said first and second deflection rollers (11, 12) are located at least approximately vertically above each other, with said first deflection roller (11) being uppermost.

3. The apparatus of claim 1, further including path deflection rollers (16, 17), located close to said theoretical rotation cylinder (8) and guiding the respective belt pairs (3, 10; 4, 9) of said delivery system in the respective delivery paths (A, B).

4. The apparatus of claim 3, wherein that one (16) of the path deflection rollers (16, 17) associated with the belt delivery system (9, 4) which includes the delivery belt (9) passed about the deflection roller closest to the theoretical rotation cylinder is adjustably journaled for adjusting the respective portions of the inlet of the associated delivery path (B) formed between the respective supply belt (4) and the associated delivery belt (9).

5. The apparatus of claim 1, wherein two deflection segments (6, 7) are located on said deflection drum (5) positioned diametrically opposite each other on the drum, and wherein the segments are dimensioned to leave a free chord length through the theoretical rotation cylinder (8) which is greater than the maximum length of the printed product passing through the theoretical rotation cylinder (8).

6. The apparatus of claim 3, wherein two deflection segments (6, 7) are located on said deflection drum (5) positioned diametrically opposite each other on the drum, and wherein the segments are dimensioned to leave a free chord length through the theoretical rotation cylinder (8) which is greater than the maximum length of the printed product passing through the theoretical rotation cylinder (8).

7. The apparatus of claim 4, wherein two deflection segments (6, 7) are located on said deflection drum (5) positioned diametrically opposite each other on the drum, and wherein the segments are dimensioned to leave a free chord length through the theoretical rotation cylinder (8) which is greater than the maximum length of the printed product passing through the theoretical rotation cylinder (8).

8. The apparatus of claim 3, wherein the supply belts (3,4) guide said printed products towards said deflection drum (5) in an essentially vertical path, and said first and second deflection rollers (11, 12) are located at least approximately vertically above each other, with said first deflection roller (11) being uppermost.

9. The apparatus of claim 4, wherein the supply belts (3,4) guide said printed products towards said deflection drum (5) in an essentially vertical path, and said first and second deflection rollers (11, 12) are located at least approximately vertically above each other, with said first deflection roller (11) being uppermost.

10. The apparatus of claim 5, wherein the supply belts (3,4) guide said printed products towards said deflection drum (5) in an essentially vertical path, and said first and second deflection rollers (11, 12) are located at least approximately vertically above each other, with said first deflection roller (11) being uppermost.

11. The apparatus of claim 6, wherein the supply belts (3, 4) guide said printed products towards said deflection drum (5) in an essentially vertical path, and said first and second deflection rollers (11, 12) are located at least approximately vertically above each other, with said first deflection roller (11) being uppermost.

12. The apparatus of claim 7, wherein the supply belts (3,4) guide said printed products towards said deflection drum (5) in an essentially vertical path, and said first and second deflection rollers (11, 12) are located at least approximately vertically above each other, with said first deflection roller (11) being uppermost.

* * * * *